US011145956B2

(12) United States Patent
Wu et al.

(10) Patent No.: US 11,145,956 B2
(45) Date of Patent: Oct. 12, 2021

(54) DUAL-POLARIZED MILLIMETER WAVE ANTENNA UNIT, ANTENNA SYSTEM, AND MOBILE TERMINAL

(71) Applicant: SHENZHEN SUNWAY COMMUNICATION CO., LTD., Shenzhen (CN)

(72) Inventors: Shengjie Wu, Shenzhen (CN); Anping Zhao, Shenzhen (CN)

(73) Assignee: SHENZHEN SUNWAY COMMUNICATION CO., LTD., Shenzhen (CN)

( * ) Notice: Subject to any disclaimer, the term of this patent is extended or adjusted under 35 U.S.C. 154(b) by 197 days.

(21) Appl. No.: 16/606,132

(22) PCT Filed: Sep. 11, 2019

(86) PCT No.: PCT/CN2019/105247

§ 371 (c)(1),
(2) Date: Oct. 17, 2019

(87) PCT Pub. No.: WO2021/012363

PCT Pub. Date: Jan. 28, 2021

(65) Prior Publication Data

US 2021/0028535 A1 Jan. 28, 2021

(30) Foreign Application Priority Data

Jul. 23, 2019 (CN) ..... 201910664228.3

(51) Int. Cl.

| | |
|---|---|
| ***H01Q 1/24*** | (2006.01) |
| ***H01Q 15/24*** | (2006.01) |
| ***H01Q 21/00*** | (2006.01) |

(52) U.S. Cl.
CPC ..... *H01Q 1/243* (2013.01); *H01Q 15/24* (2013.01); *H01Q 21/0006* (2013.01)

(58) Field of Classification Search
CPC .... H01Q 1/243; H01Q 15/24; H01Q 21/0006; H01Q 21/24; H01Q 21/0075; H01Q 9/0478
See application file for complete search history.

(56) References Cited

U.S. PATENT DOCUMENTS

| | | | | |
|---|---|---|---|---|
| 2020/0161749 | A1* | 5/2020 | Onaka | H01P 3/08 |
| 2020/0287298 | A1* | 9/2020 | Ueda | H01Q 21/24 |
| 2021/0066788 | A1* | 3/2021 | Kim | H01Q 1/243 |

* cited by examiner

*Primary Examiner* — Awat M Salih
(74) *Attorney, Agent, or Firm* — Oliff PLC

(57) ABSTRACT

A dual-polarized millimeter wave antenna unit, an antenna system, and a mobile terminal are disclosed. The dual-polarized millimeter wave antenna unit comprises a main part, a first feed branch, a second feed branch, and a radiator, wherein the radiator is arranged on the top face of the main part, the first feed branch is arranged on a first side face of the main part, the second feed branch is arranged on a second side face of the main body, the first feed branch and the second feed branch are communicated with the bottom face of the main part, the first side face is perpendicular to the second side face, and a weld region is arranged on the bottom face of the main part. The dual-polarized millimeter wave antenna unit provided by the invention has the advantages of wideband, dual polarization, and low sidelobe, thus being especially suitable for 5G communication.

19 Claims, 9 Drawing Sheets

DUAL-POLARIZED MILLIMETER WAVE ANTENNA UNIT, ANTENNA SYSTEM, AND MOBILE TERMINAL

TECHNICAL FIELD

The invention relates to the technical field of antennas, in particular to a dual-polarized millimeter wave antenna unit, an antenna system, and a mobile terminal.

DESCRIPTION OF RELATED ART

The millimeter wave band having rich spectrum resources are used as one of communication bands of a 5G communication system. There are many design difficulties to apply millimeter wave antennas, which are essential parts of a communication system, to terminals. Due to the large attenuation of millimeter waves during propagation, antennas have to be configured in an array manner to increase the gain; and meanwhile, to improve the throughput of the communication system, the scheme of applying dual-polarized antennas to hand-held devices has been put forward by people. Besides, to achieve the beam scanning of antenna arrays, chips generally need to be integrated at the rear terminals of the antenna arrays to control the amplitude and phase of each antenna branch. In order to obtain good beam scanning performance, it is necessary to acquire the initial amplitude and phase of the feed terminal of each antenna unit, and the amplitude distribution and phase difference of each branch are controlled by the chips to achieve the beam scanning. A method for easily acquiring the initial amplitude and phase is to separate the antennas from the circuits located at the rear terminals of the antennas, and the antennas and the circuits are connected again after the initial amplitude and phase of the circuits are tested.

Chinese Invention Patent Applications Publication No. CN109786959A and CN105932409A disclose a wideband millimeter wave antenna, but such wideband millimeter wave antenna cannot realize dual polarization.

BRIEF SUMMARY OF THE INVENTION

The technical issue to be settled by the invention is to provide a wideband dual-polarized millimeter wave antenna unit, an antenna system, and a mobile terminal which are suitable for 5G communication.

To settle the above-mentioned technical issue, the first technical solution adopted by the invention is as follows: a dual-polarized millimeter wave antenna unit comprises a main part, a first feed branch, a second feed branch, and a radiator, wherein the radiator is arranged on the top face of the main part, the first feed branch is arranged on a first side face of the main part, the second feed branch is arranged on a second side face of the main body, the first feed branch and the second feed branch are communicated with the bottom face of the main part, the first side face is perpendicular to the second side face, and a weld region is arranged on the bottom face of the main part.

To settle the above-mentioned technical issue, the second technical solution adopted by the invention is as follows: an antenna system comprises a circuit board and the dual-polarized millimeter wave antenna unit, wherein a ground layer is arranged on the bottom face of the circuit board, and at least one dual-polarized millimeter wave antenna unit is welded on the top face of the circuit board.

To settle the above-mentioned technical issue, the third technical solution adopted by the invention is as follows: a mobile terminal comprises the antenna system.

The invention has the following beneficial effects: the antenna unit has the advantages of wideband, dual polarization, and low sidelobe, thus being especially suitable for 5G communication; and the antenna unit can be attached to the circuit board by means of a surface-mount technology, is wide in application range, convenient to assemble and capable of improving the production efficiency of the antenna system, meets the requirement for independently testing the initial amplitude and phase of circuits, and reduces the performance debugging difficulty of the antenna system.

REFERENCE SIGNS

Figure 1:
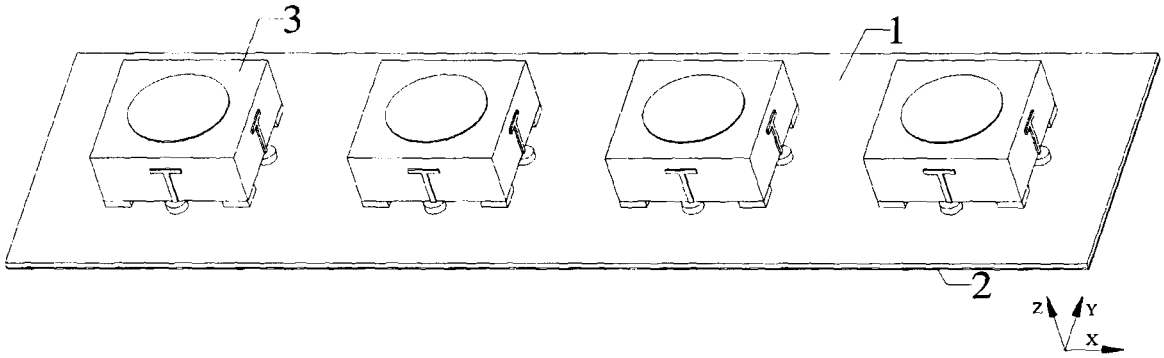
FIG. 1 is an overall structural view of an antenna system of the invention.

1, circuit board; 2, ground layer; 3, dual-polarized millimeter wave antenna unit; 4, main part; 5, first feed branch; 6, second feed branch; 7, radiator; 8, first patch; 9, second patch; 10, first pad; 11, third patch; 12, fourth patch; 13, third pad; 14, fourth pad; 15, first feed port; 16, second feed port; 17, first isolation region; 18, second isolation region; 19, circuit; 20, dual-polarized amplitude-phase control chip; 21, single-polarized amplitude-phase control chip.

DETAILED DESCRIPTION OF THE INVENTION

The technical contents, purposes, and effects of the invention are expounded as follows in combination with the embodiments and accompanying drawings.

Referring to FIG. 1 to FIG. 18, a dual-polarized millimeter wave antenna unit comprises a main part 4, a first feed branch 5, a second feed branch 6, and a radiator 7, wherein the radiator 7 is arranged on the top face of the main part 4, the first feed branch 5 is arranged on a first side face of the main part 4, the second feed branch 6 is arranged on a second side face of the main body 4, the first feed branch 5 and the second feed branch 6 are communicated with the bottom face of the main part 4, the first side face is perpendicular to the second side face, and a weld region is arranged on the bottom face of the main part 4.

The structural/operating principle of the invention is briefly described as follows: the first feed branch 5 and the second feed branch 6 are respectively arranged on the two perpendicular side faces and can be coupled to excite the radiator 7 to fulfill a wideband; and during feed, currents of the radiator 7 are kept perpendicular by means of a 90° angle between the first feed branch and the second feed branch, so that dual polarization is fulfilled.

From the above description, the invention has the following beneficial effects: the antenna unit has the advantages of wideband, dual polarization, and low sidelobe, thus being especially suitable for 5G communication; and the antenna unit can be attached to a circuit board 1 by means of a surface-mount technology, is wide in application range, convenient to assemble and capable of improving the production efficiency of an antenna system, meets the requirement for independently testing the initial amplitude and phase of circuits, and reduces the performance debugging difficulty of the antenna system.

Furthermore, the main part 4 is a rectangular ceramic body.

From the above description, the first side face and the second side face are two adjacent side faces of the ceramic body.

Furthermore, an L-shaped first patch 8 and a second patch 9 are arranged in the weld region and are located at diagonal opposite angles of the bottom face of the main part 4.

From the above description, the main part 4 is stably connected with an external member (such as the circuit board 1), so that the structural stability of the antenna system is improved.

Furthermore, a third patch 11 conductive with the first feed branch 5 and a fourth patch 12 conductive with the second feed branch 6 are arranged on the bottom face of the main part 4.

From the above description, the third patch and the fourth patch are configured to make the feed of the antenna unit more stable.

An antenna system comprises a circuit board 1 and the dual-polarized millimeter wave antenna unit 3, wherein a ground layer 2 is arranged on the bottom face of the circuit board 1, and at least one dual-polarized millimeter wave antenna unit 3 is welded on the top face of the circuit board 1.

From the above description, the antenna system at least has all the beneficial effects of the dual-polarized millimeter wave antenna unit 3.

Furthermore, the circuit board is provided with a first pad 10, a first feed port 15, and a second feed port 16; the first pad 10 corresponds to the weld region and is conductive with the ground layer 2, the first feed port 15 is electrically connected with the first feed branch 5, and the second feed port 16 is electrically connected with the second feed branch 6; and a first isolation region 17 and a second isolation region 18 are arranged on the ground layer 2, one terminal of the first feed port 15 is located in the first isolation region 17, and one terminal of the second feed port 16 is located in the second isolation region 18.

From the above description, the first isolation region and the second isolation region are configured to prevent short circuits.

Furthermore, the circuit board is provided with a plurality of circuits and a dual-polarized amplitude-phase control chip, and the first feed branch and the second feed branch are electrically connected with the dual-polarized amplitude-phase control chip through the circuits.

Furthermore, the circuit board is provided with a plurality of circuits and two single-polarized amplitude-phase control chips, the first feed branch is electrically connected with one single-polarized amplitude-phase control chip through the corresponding circuit, and the second feed branch is electrically connected with the other single-polarized amplitude-phase control chip through the corresponding circuit.

Furthermore, the circuits have identical phases.

A mobile terminal comprises the antenna system.

From the above description, the mobile terminal at least has all the beneficial effects of the antenna system.

Embodiment 1

Referring to FIG. 1 to FIG. 17, Embodiment 1 of the invention is as follows: a mobile terminal comprises an antenna system. As shown in FIG. 1, the antenna system comprises a circuit board 1, wherein a ground layer 2 is arranged on the bottom face of the circuit board 1, and at least one dual-polarized millimeter wave antenna unit 3 is welded on the top face of the circuit board 1.

Figure 2:
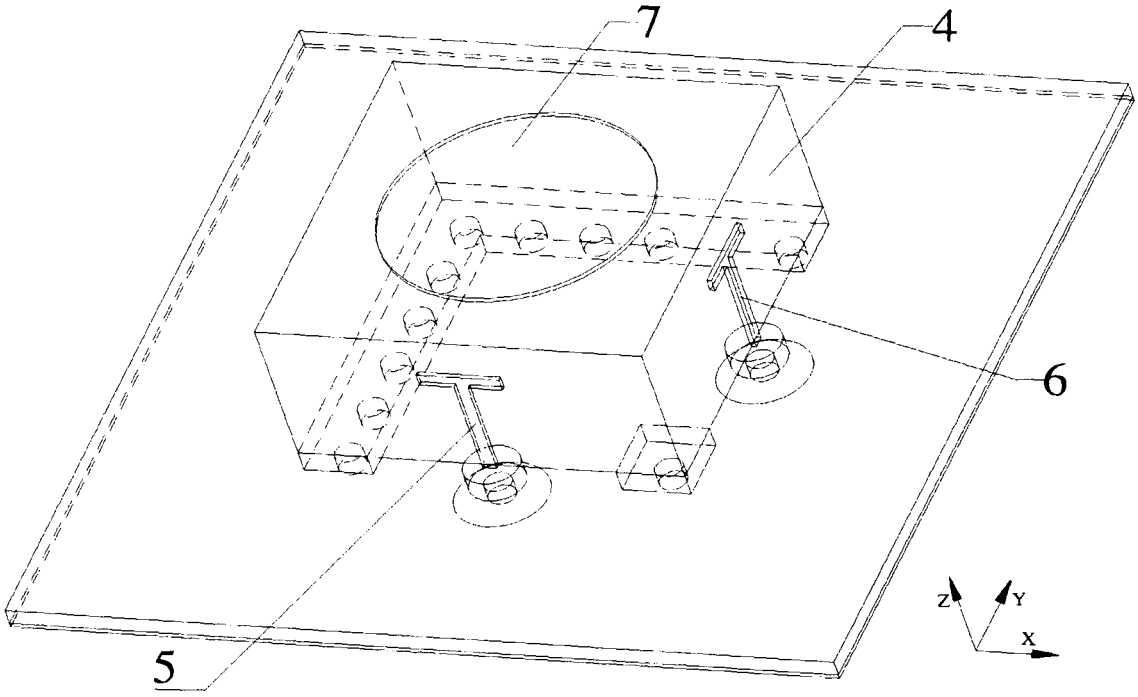
FIG. 2 is a structural view of an antenna unit of the invention.
Figure 3:
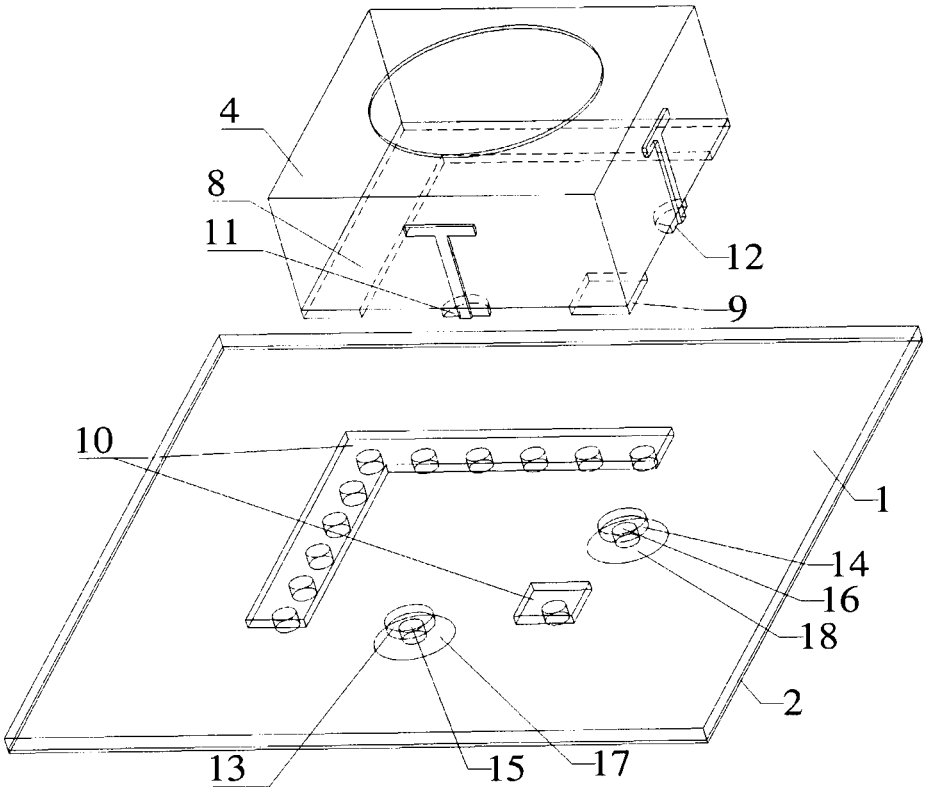
FIG. 3 is an exploded view of the antenna unit of the invention.

Referring to FIG. 2 and FIG. 3, the dual-polarized millimeter wave antenna unit 3 comprises a main part 4, a first feed branch 5, a second feed branch 6, and a radiator 7, wherein the radiator 7 is arranged on the top face of the main part 4, the first feed branch 5 is arranged on a first side face of the main part 4, the second feed branch 6 is arranged on a second side face of the main body 4, the first feed branch 5 and the second feed branch 6 are communicated with the bottom face of the main part 4, the first side face is perpendicular to the second side face, and a weld region is arranged on the bottom face of the main part 4. Optionally, the main part 4 is a rectangular ceramic body.

The first feed branch 5 and the second feed branch 6 are in an I shape or in a T shape. To reduce the height of the main part 4 and reduce the size of the antenna unit, in this embodiment, the first feed branch 5 and the second feed branch 6 are in the T shape. The radiator 7 is a metal patch and is circular regular polygonal. The resonant frequency of an antenna is determined by the size of the metal patch (the radiator 7), the resonant frequency increases with the increase of the area of the metal patch, and vice versa. The size of the T-shaped feed branches determines antenna matching, and good impedance matching of the antenna can be fulfilled through control over the height of vertical sections of the T-shaped feed branches and the length of horizontal sections of the T-shaped feed branches.

As shown in FIG. 3, an L-shaped first patch 8 and a second patch 9 are arranged in the weld region and are located at diagonal opposite angles of the bottom face of the main part 4. A first pad 10 is arranged on the top face of the circuit board 1, corresponds to the weld region, and is conductive with the ground layer 2. Particularly, the first pad 10 includes an L-shaped part corresponding to the first patch 8 and a rectangular part corresponding to the second patch 9, wherein first plated-through holes conductive with the ground layer 2 are respectively formed in the L-shaped part and/or the rectangular part.

To improve the connection and conduction stability of the antenna system, a third patch 11 conductive with the first feed branch 5 and a fourth patch 12 conductive with the second feed branch 6 are arranged on the bottom face of the main part 4. Preferably, a third pad 13 welded on the third patch 11 and a fourth pad 14 welded on the fourth patch 12 are arranged on the top face of the circuit board 1. In this embodiment, the third patch 11 and the fourth patch 12 are semi-circular, and the third pad 13 and the fourth pad 14 are circular.

Referring to FIG. 2 and FIG. 3, furthermore, the circuit board 1 is also provided with a first feed port 15 and a second feed port 16; the first feed port 15 is electrically connected with the first feed branch 5, and the second feed port 16 is electrically connected with the second feed branch 6; and a first isolation region 17 and a second isolation region 18 are arranged on the ground layer 2, one terminal of the first feed port 15 is located in the first isolation region 17, and one terminal of the second feed port 16 is located in the second isolation region 18. In this embodiment, the first feed port 15 and the second feed port 16 are second plated-through holes formed in the circuit board 1. It can be seen that the third patch 11 and the third pad 13 are matched to fulfill stable feed of the first feed branch 5, and the fourth patch 12 and the fourth pad 14 are matched to fulfill stable feed of the second feed branch 6.

Before the dual-polarized millimeter wave antenna unit 3 is attached, the initial phase and amplitude of the feed ports in the circuit board 1 are detected by instruments, the performance of each antenna unit is independently tested, and after it is confirmed that the initial phase and amplitudes of the feed ports and the performance of each antenna unit are correct, the antenna unit is attached to the corresponding pad of the PCB, so that the debugging difficulty of the antenna system is effectively reduced.

Figure 4:
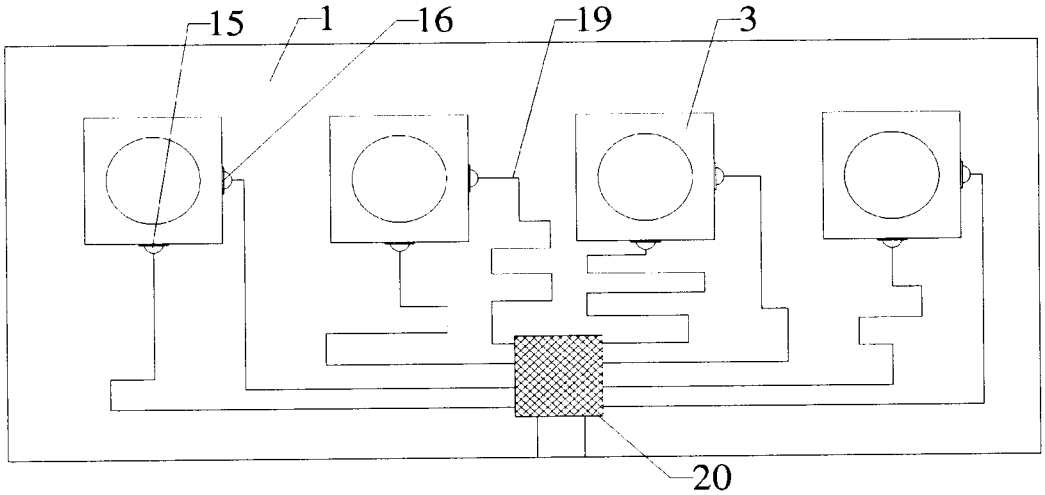
FIG. 4 is a circuit connection diagram of the antenna system in Embodiment 1 of the invention.

As shown in FIG. 4, in this embodiment, the circuit board 1 is provided with a plurality of circuits 19 and a dual-polarized amplitude-phase control chip 20, the first feed branch 5 and the second feed branch 6 are electrically connected with the dual-polarized amplitude-phase control chip 20 through the circuits 19, and the dual-polarized amplitude-phase control chip 20 is provided with a power divider, a low-noise amplifier, a power amplifier, a radio-frequency switch, and other elements to fulfill control and switching of transmission and reception.

As shown in FIG. 1, when the circuit board 1 is provided with a plurality of dual-polarized millimeter wave antenna units 3, the plurality of dual-polarized millimeter wave antenna unit 3 are arrayed in at least one row. Thus, the linear distances from the dual-polarized millimeter wave antenna units 3 to the dual-polarized amplitude-phase control chip 20 are different. In this embodiment, bent parts are configured on the circuits 19 to keep the phases of the circuits 19 identical. In other embodiments, the circuits 19 can also be linear, and chips are finally configured to keep the amplitudes and phases of all branches identical to realize beam forming and beam scanning of an antenna array.

In this embodiment, the circuit board 1 is provided with four dual-polarized millimeter wave antenna units 3 arrayed in one row.

The polarization obtained during feed of the first feed ports 15 is defined as 90° polarization, and the polarization obtained during feed of the second feed ports 16 is defined as 0° polarization. A 90° polarization pattern of the antenna system can be obtained by synchronous excitation of the four first feed ports 15, and similarly, a 0° polarization pattern of the antenna system can be obtained by synchronous excitation of the four second feed ports 16.

Figure 5:
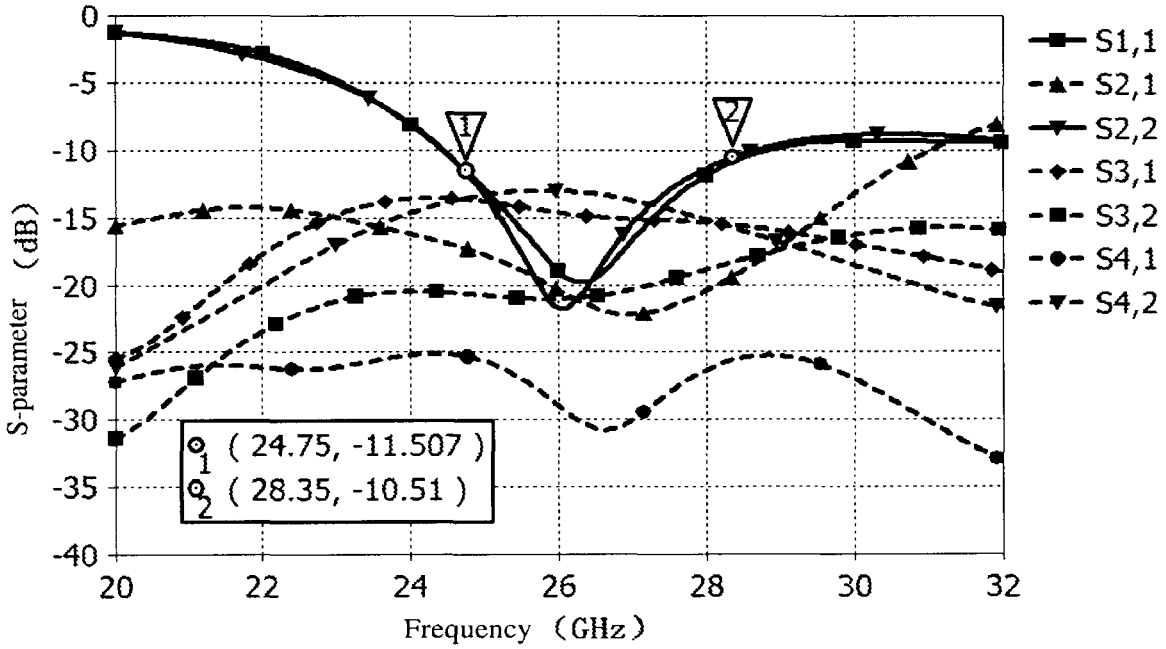
FIG. 5 is an S-parameter diagram of the antenna unit in the antenna system of the invention.

FIG. 5 shows S-parameters of the antenna unit in the antenna system. In FIG. 5, S11 and S22 represent return loss of the two feed ports of the antenna unit, and other curves (S21, S32, S31, S41, and S42) represent the isolation between the feed ports of the antenna unit and adjacent antenna units. It can be seen from FIG. 5 that the return loss of the antenna unit from 24.75 GHz to 28.35 GHz is less than −10 dB so as to meet the 5G millimeter wave band (24.75 GHz-27.5 GHz) planned in China and the 5G millimeter wave band of 28 GHz (27.5 GHz-28.35 GHz) planned in US, and the isolation between the ports of the antenna unit and the adjacent antenna units within the whole bandwidth is less than −13 dB.

Figure 6:
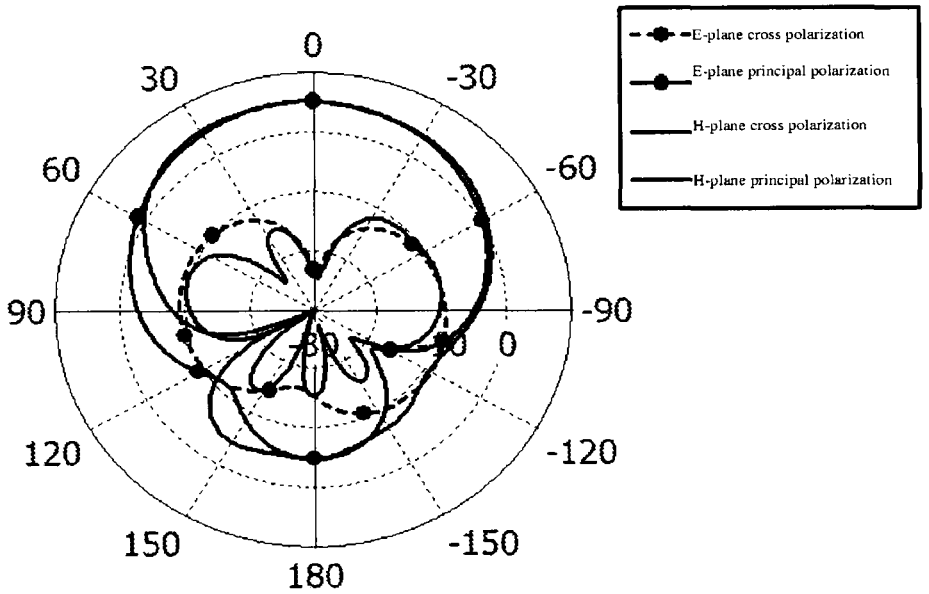
FIG. 6 is a cross polarization pattern (during feed of a first feed port) of the antenna unit, at 25 GHz, in the antenna system of the invention.
Figure 7:
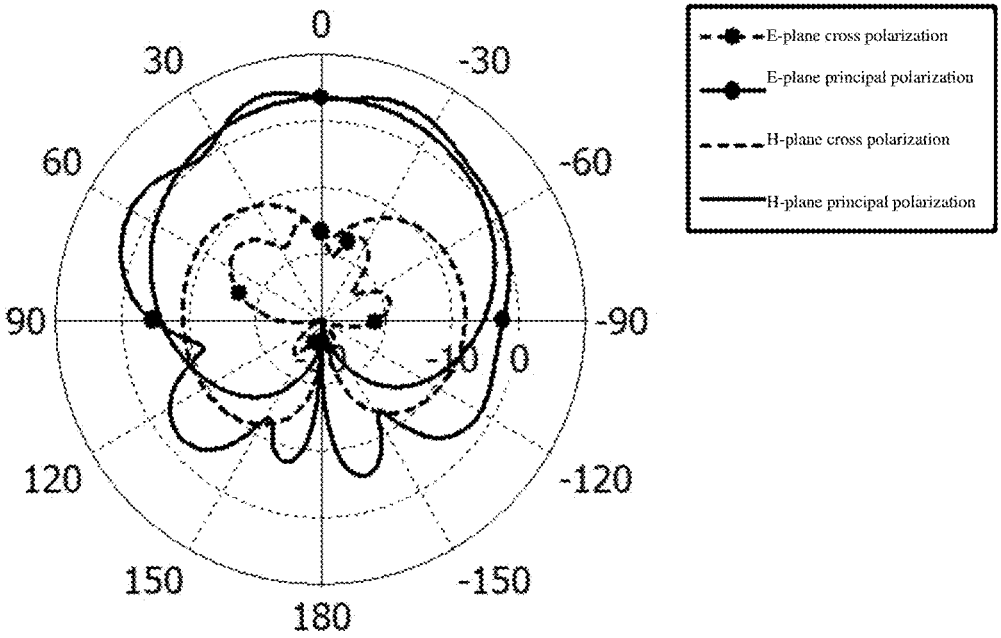
FIG. 7 is a cross polarization pattern (during feed of a second feed port) of the antenna unit, at 25 GHz, in the antenna system of the invention.
Figure 8:
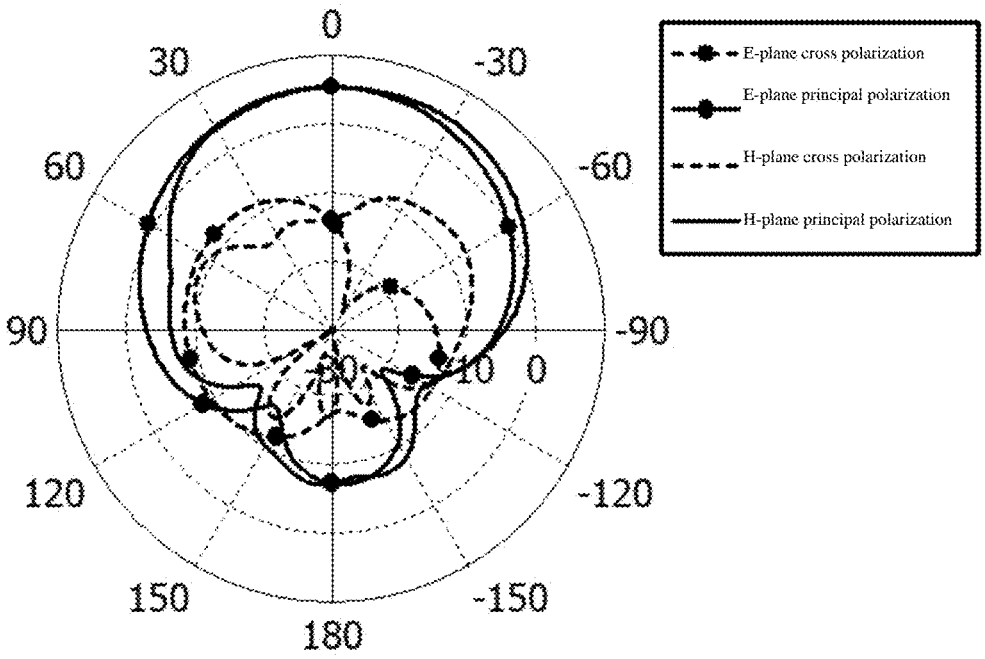
FIG. 8 is a cross polarization pattern (during feed of the first feed port) of the antenna unit, at 28 GHz, in the antenna system of the invention.
Figure 9:
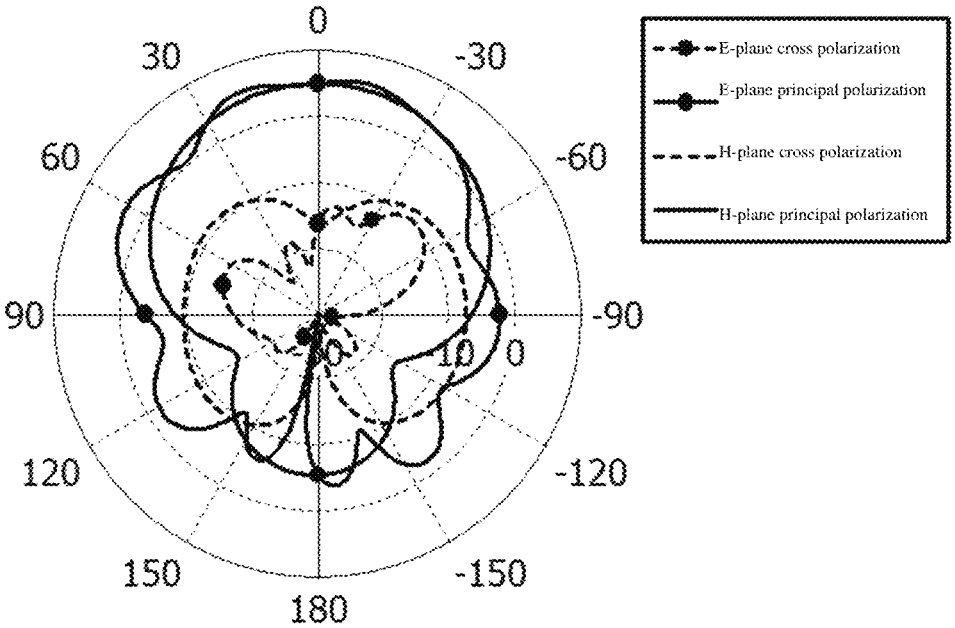
FIG. 9 is a cross polarization pattern (during feed of the second feed port) of the antenna unit, at 28 GHz, in the antenna system of the invention.

FIG. 6 and FIG. 7 respectively show cross polarization patterns of the two polarizations of the antenna unit, at 25 GHz, in the antenna system, and FIG. 8 and FIG. 9 respectively show cross polarization patterns of the two polarizations of the antenna unit, at 28 GHz, in the antenna system. It can be seen from FIG. 6 to FIG. 9 that polarization isolation in a primary radiation direction (Theta=0°) is less than 15 dB.

Figure 10:
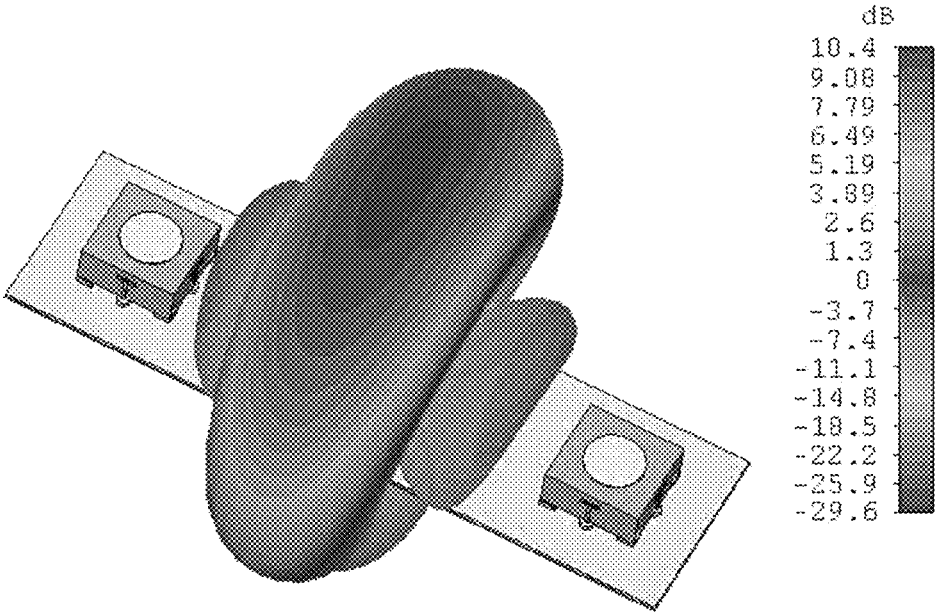
FIG. 10 is a 3D radiation pattern (during feed of first feed ports of all antenna units) of an antenna array, at 25 GHz, in the antenna system of the invention.
Figure 11:
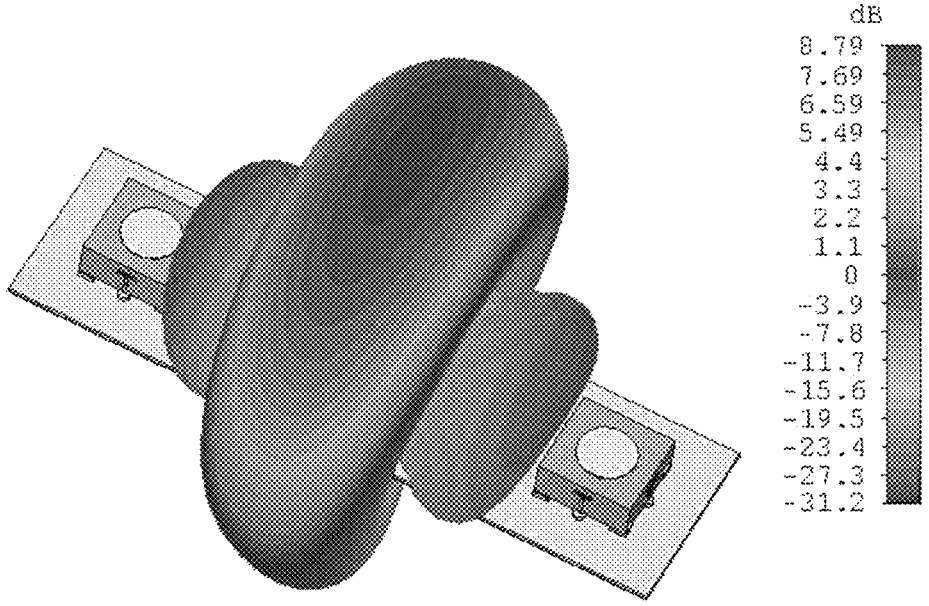
FIG. 11 is a 3D radiation pattern (during feed of second feed ports of all the antenna units) of the antenna array, at 25 GHz, in the antenna system of the invention.
Figure 12:
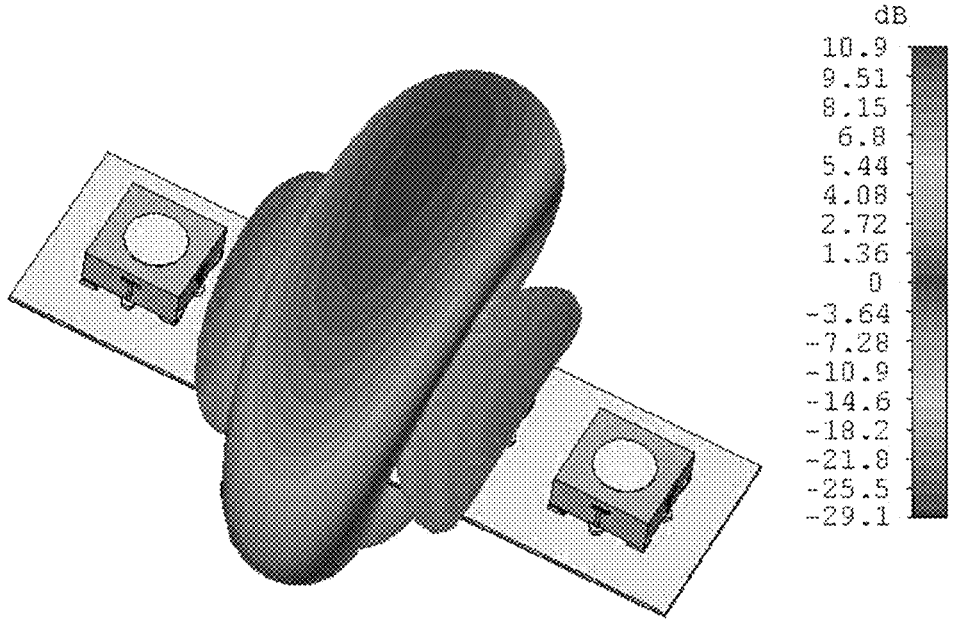
FIG. 12 is a 3D radiation pattern (during feed of the first feed ports of all the antenna units) of the antenna array, at 28 GHz, in the antenna system of the invention.
Figure 13:
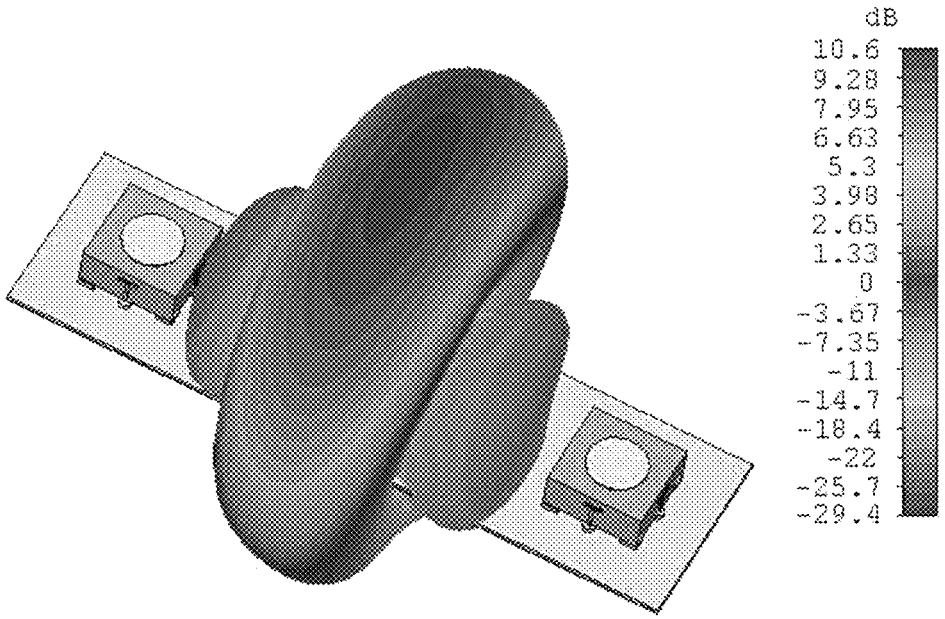
FIG. 13 is a 3D radiation pattern (during feed of the second feed ports of all the antenna units) of the antenna array, at 28 GHz, in the antenna system of the invention.
Figure 14:
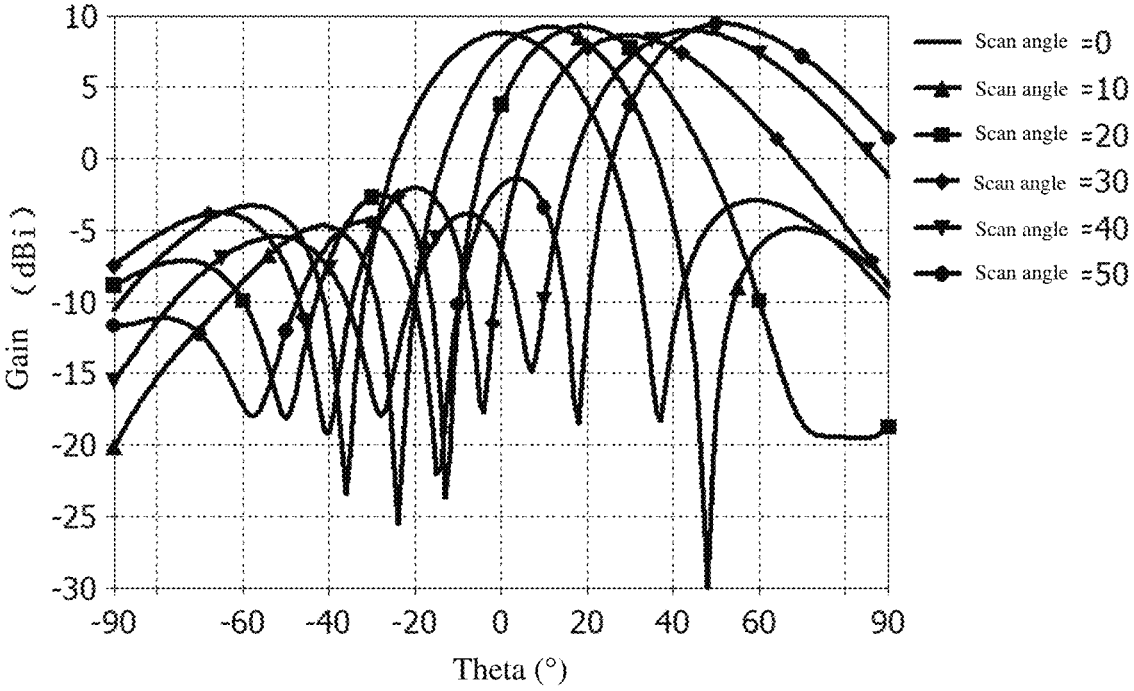
FIG. 14 is a 0° polarization pattern of the antenna system, at 25 GHz, of the invention in an xoz plane at a scan angle of 0°-50° in a Theta direction.
Figure 15:
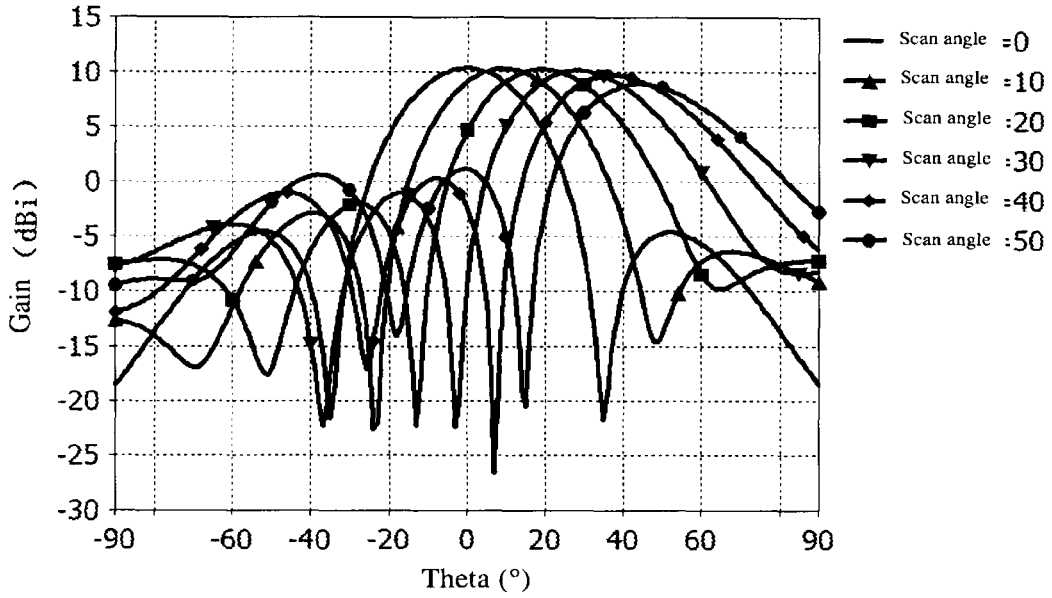
FIG. 15 is a 90° polarization pattern of the antenna system, at 25 GHz, of the invention in the xoz plane at the scan angle of 0°-50° in the Theta direction.
Figure 16:
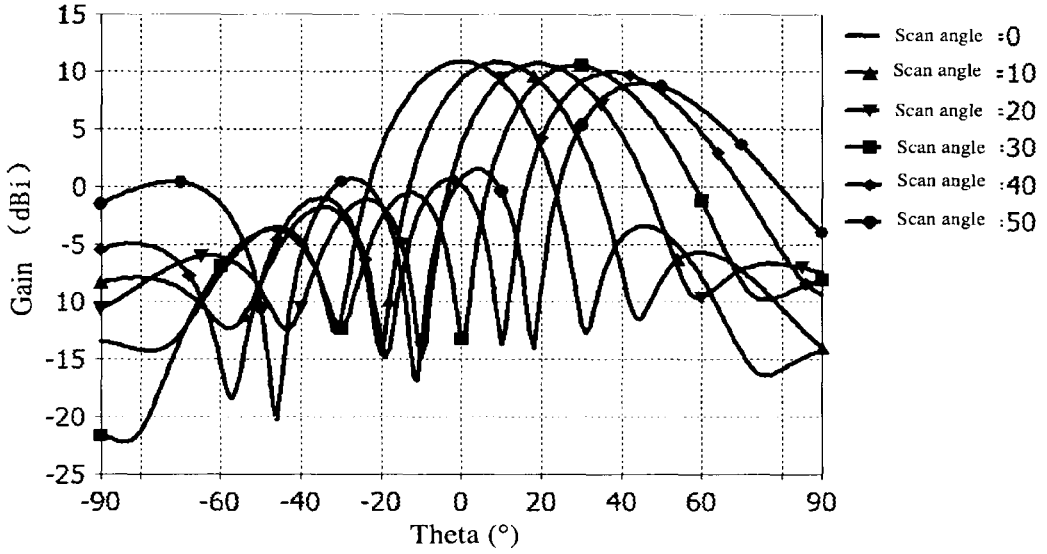
FIG. 16 is a 0° polarization pattern of the antenna system, at 28 GHz, of the invention in the xoz plane at the scan angle of 0°-50° in the Theta direction.
Figure 17:
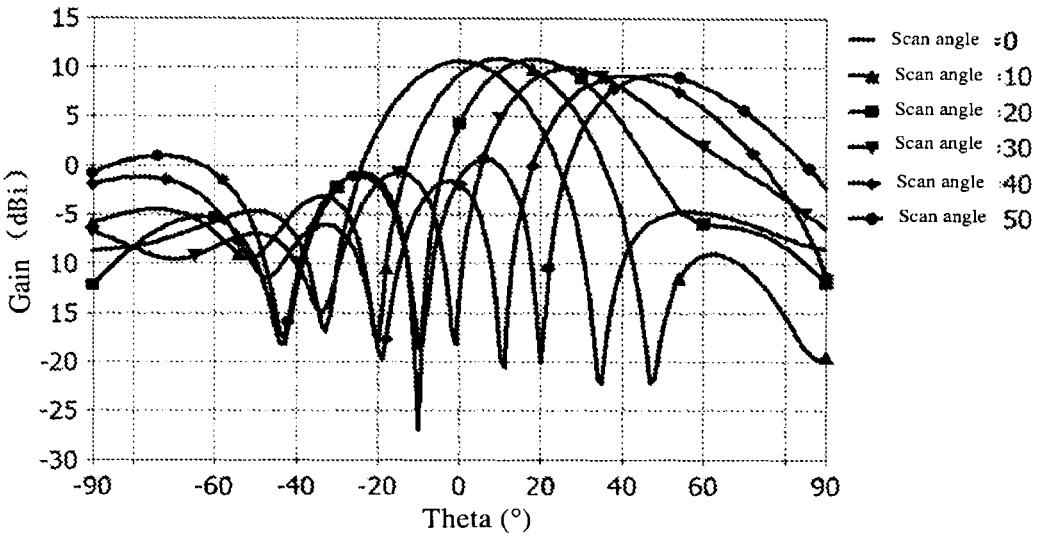
FIG. 17 is a 90° polarization pattern of the antenna system, at 28 GHz, of the invention in the xoz plane at the scan angle of 0°-50° in the Theta direction.
Figure 18:
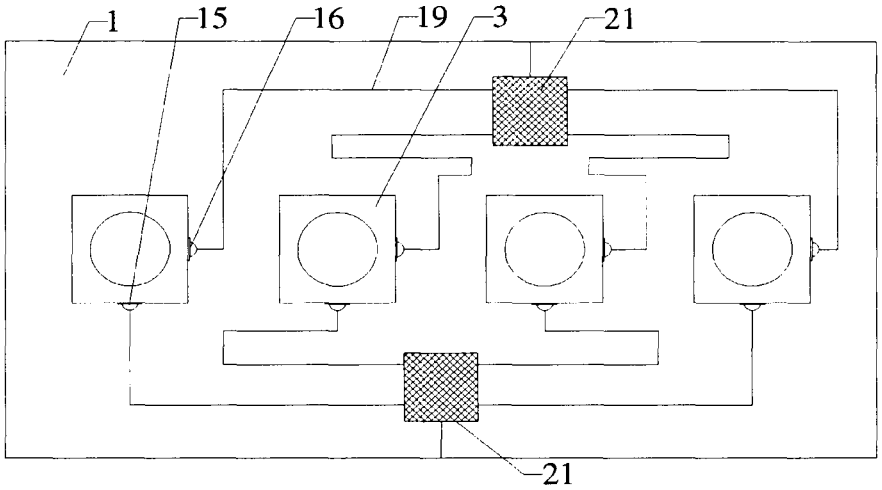
FIG. 18 is a circuit connection diagram of the antenna system in Embodiment 2 of the invention.

FIG. 10 and FIG. 11 respectively show two 3D radiation patterns of the two polarizations of the antenna system at 25 GHz, and FIG. 12 and FIG. 13 respectively show 3D radiation patterns of the two polarizations of the antenna system at 28 GHz. It can be seen from FIG. 10 to FIG. 13 that the radiation direction of the antenna is exactly upward. The beam scanning function is very important for a 5G millimeter wave antenna array. FIG. 14, FIG. 15, FIG. 16, and FIG. 17 respectively show a 0° polarization pattern and a 90° polarization pattern of the antenna system, at 25 GHz and 28 GHz, in an xoz plane at a scan angle of from 0°-50° in a Theta (−90°~90° direction. It can be seen from these figures that the antenna system still has a high sidelobe ratio and a large good gain at a large scan angle, thereby having a goodbeam scanning function.

Embodiment 2

Referring to FIG. 1 to FIG. 3 and FIG. 5 to FIG. 18, Embodiment 2 of the invention is another technical solution of the antenna system composed of the antenna array and the amplitude-phase control chip put forward on the basis of Embodiment 1. Different from Embodiment 1, single-polarized amplitude-phase control chips 21 are adopted in this embodiment. Particularly, referring to FIG. 18, the circuit board 1 is provided with a plurality of circuits 19 and two single-polarized amplitude-phase control chips 21, the first feed branch 5 is electrically connected with one single-polarized amplitude-phase control chip 21 through the corresponding circuit 19, and the second feed branch 6 is electrically connected with the other single-polarized amplitude-phase control chip 21 through the corresponding circuit 19. The single-polarized amplitude-phase control chips 21 are commercially-available existing chips and can be directly purchased by manufacturers.

Optionally, the circuits 19 have identical phases.

In conclusion, the dual-polarized millimeter wave antenna unit, the antenna system, and the mobile terminal which are provided by the invention have the advantages of wideband, dual polarization, and low sidelobe, thus being especially suitable for 5G communication. The antenna unit can be attached to the circuit board by means of a surface-mount technology, is wide in application range, convenient to assemble and capable of improving the production efficiency of the antenna system, meets the requirement for independently testing the initial amplitude and phase of the circuits, and reduces the performance debugging difficulty of the antenna system.

The above embodiments are only preferred ones of the invention, and are not intended to limit the patent scope of the invention. All equivalent transformations obtained on the basis of the contents in the specification and the accompanying drawings of the invention, or direct or indirect applications to related technical fields should also fall within the patent protection scope of the invention.

The invention claimed is:

1. A dual-polarized millimeter wave antenna unit, wherein the dual-polarized millimeter wave antenna unit comprises a main part, a first feed branch, a second feed branch, and a radiator, the radiator is arranged on a top face of the main part, the first feed branch is arranged on a first side face of the main part, the second feed branch is arranged on a second side face of the main body, the first feed branch and the second feed branch are communicated with a bottom face of the main part, the first side face is perpendicular to the second side face, a weld region is arranged on the bottom face of the main part, and wherein an L-shaped first patch and a second patch are arranged in the weld region and are located at diagonal opposite angles of the bottom face of the main part.

2. The dual-polarized millimeter wave antenna unit according to claim 1, wherein the main part is a rectangular ceramic body.

3. The dual-polarized millimeter wave antenna unit according to claim 1, wherein a third patch conductive with the first feed branch and a fourth patch conductive with the second feed branch are arranged on the bottom face of the main part.

4. An antenna system, comprising a circuit board, wherein the antenna system further comprises a dual-polarized millimeter wave antenna unit, the dual-polarized millimeter wave antenna unit comprise a main part, a first feed branch, a second feed branch, and a radiator, wherein the radiator is arranged on a top face of the main part, the first feed branch is arranged on a first side face of the main part, the second feed branch is arranged on a second side face of the main body, the first feed branch and the second feed branch are communicated with a bottom face of the main part, the first side face is perpendicular to the second side face, and a weld region is arranged on the bottom face of the main part; a ground layer is arranged on a bottom face of the circuit board, and at least one said dual-polarized millimeter wave antenna unit is welded on a top face of the circuit board.

5. The antenna system according to claim 4, wherein the circuit board is provided with a first pad, a first feed port, and a second feed port; the first pad corresponds to the weld region and is conductive with the ground layer, the first feed port is electrically connected with the first feed branch, and the second feed port is electrically connected with the second feed branch; and a first isolation region and a second isolation region are arranged on the ground layer, a terminal of the first feed port is located in the first isolation region, and a terminal of the second feed port is located in the second isolation region.

6. The antenna system according to claim 4, wherein the circuit board is provided with a plurality of circuits and a dual-polarized amplitude-phase control chip, and the first feed branch and the second feed branch are electrically connected with the dual-polarized amplitude-phase control chip through the circuits.

7. The antenna system according to claim 6, wherein the circuits have identical phases.

8. The antenna system according to claim 4, wherein the circuit board is provided with a plurality of circuits and two single-polarized amplitude-phase control chips, the first feed branch is electrically connected with one said single-polarized amplitude-phase control chip through the corresponding circuit, and the second feed branch is electrically connected with the other single-polarized amplitude-phase control chip through the corresponding circuit.

9. The antenna system according to claim 8, wherein the circuits have identical phases.

10. The antenna system according to claim 4, wherein the main part is a rectangular ceramic body.

11. The antenna system according to claim 10, wherein the circuit board is provided with a first pad, a first feed port, and a second feed port; the first pad corresponds to the weld region and is conductive with the ground layer, the first feed port is electrically connected with the first feed branch, and the second feed port is electrically connected with the second feed branch; and a first isolation region and a second isolation region are arranged on the ground layer, a terminal of the first feed port is located in the first isolation region, and a terminal of the second feed port is located in the second isolation region.

12. The antenna system according to claim 10, wherein the circuit board is provided with a plurality of circuits and a dual-polarized amplitude-phase control chip, and the first feed branch and the second feed branch are electrically connected with the dual-polarized amplitude-phase control chip through the circuits.

13. The antenna system according to claim 12, wherein the circuits have identical phases.

14. The antenna system according to claim 10, wherein the circuit board is provided with a plurality of circuits and two single-polarized amplitude-phase control chips, the first feed branch is electrically connected with one said single-polarized amplitude-phase control chip through the corresponding circuit, and the second feed branch is electrically connected with the other single-polarized amplitude-phase control chip through the corresponding circuit.

15. The antenna system according to claim 14, wherein the circuits have identical phases.

16. A mobile terminal, wherein the mobile terminal comprises the antenna system according to claim 14.

17. The mobile terminal according to claim 16, wherein the circuit board is provided with a plurality of circuits and a dual-polarized amplitude-phase control chip, and the first feed branch and the second feed branch are electrically connected with the dual-polarized amplitude-phase control chip through the circuits.

18. The mobile terminal according to claim 16, wherein the circuit board is provided with a plurality of circuits and two single-polarized amplitude-phase control chips, the first feed branch is electrically connected with one said single-polarized amplitude-phase control chip through the corresponding circuit, and the second feed branch is electrically connected with the other single-polarized amplitude-phase control chip through the corresponding circuit.

19. The mobile terminal according to claim 16, wherein the main part is a rectangular ceramic body.

* * * * *